US007980783B2

(12) United States Patent
Jaszkowiak

(10) Patent No.: US 7,980,783 B2
(45) Date of Patent: Jul. 19, 2011

(54) LINEAR LOST MOTION POSITIONING MECHANISM

(76) Inventor: Timothy S. Jaszkowiak, Boise, ID (US)

( * ) Notice: Subject to any disclaimer, the term of this patent is extended or adjusted under 35 U.S.C. 154(b) by 1243 days.

(21) Appl. No.: 11/615,719

(22) Filed: Dec. 22, 2006

(65) Prior Publication Data

US 2008/0152429 A1 Jun. 26, 2008

(51) Int. Cl.
*E01C 19/22* (2006.01)
*B24B 23/00* (2006.01)

(52) U.S. Cl. ..... 404/112; 451/353; 404/97

(58) Field of Classification Search ..... 404/112, 404/97; 451/353; 416/27
See application file for complete search history.

(56) References Cited

U.S. PATENT DOCUMENTS 2,207,042 A * 7/1940 Waseige ..... 416/27
4,577,993 A * 3/1986 Allen et al. ..... 404/112
4,673,311 A * 6/1987 Whiteman, Jr. ..... 404/112
5,096,330 A * 3/1992 Artzberger ..... 404/97
5,147,146 A * 9/1992 Harding, Jr. ..... 404/97
5,405,216 A * 4/1995 Allen et al. ..... 404/112
5,993,109 A * 11/1999 Motl et al. ..... 404/112
6,196,083 B1 * 3/2001 Pasko et al. ..... 74/518
6,739,798 B2 * 5/2004 Vandewinckel et al. ..... 404/112
7,044,682 B2 * 5/2006 Glenn et al. ..... 404/112
2002/0150426 A1 * 10/2002 Vandewinckel et al. ..... 404/112

* cited by examiner

*Primary Examiner* — Thomas B Will
*Assistant Examiner* — Abigail A Risic
(74) *Attorney, Agent, or Firm* — Zarian Midgley & Johnson PLLC

(57) ABSTRACT

A linear lost motion mechanism is located within a tubular handle of a machine, such as a concrete finishing machine. The linear lost motion mechanism includes a pitch block configured to selectively frictionally lock with the tubular handle or a component attached to the tubular handle using a biasing spring. The linear lost motion mechanism can perform a number of functions, such as controlling a blade pitch adjustment system of a concrete finishing machine.

15 Claims, 5 Drawing Sheets

LINEAR LOST MOTION POSITIONING MECHANISM

BACKGROUND

The present application relates generally to linear lost motion mechanisms, and, more particularly, to linear lost motion mechanisms located within a tubular handle of a machine, such as a concrete finishing machine.

Concrete finishing machines have been used for many years to level and finish large concrete pads. Such machines typically include a rotatable trowel blade assembly having a plurality (e.g., three or four) generally planar trowel blades mounted on trowel arms projecting radially outwardly from a common hub, all of which are rotated by a gasoline-powered engine. The trowel blades rest directly on the concrete surface to be finished and support the machine's entire weight.

Concrete finishing machines typically further include means for controllably pivoting the trowel blades about their respective radial axes, to change their pitch relative to the concrete surface to be finished. Changing the blades' pitch correspondingly changes the proportion of blade surface contacting the concrete surface, such that the machine's weight is supported by a larger or smaller area of the surface.

In use, a concrete finishing machine makes several passes over the concrete surface as the concrete hardens, with the blade pitch being specially selected for each pass. In the initial pass, when the concrete is still very wet and plastic, the blade pitch is usually adjusted to be substantially parallel with the concrete surface, thereby lying flat upon it and spreading the machine's weight over a maximum surface area. In subsequent passes, as the concrete hardens and becomes less plastic, the blade pitch is progressively increased, with the pitch used in the final pass sometimes being as much as about 30 degrees.

Improvements in recent concrete formulations have made some concrete slabs include pockets or areas of varying plasticity. In such situations, it can be desirable to rapidly adjust the trowel blade pitch in order to produce the desired finish. It can also be desirable to adjust the trowel blade pitch when the machine is being moved to an adjacent area where the concrete is at a different stage of hardness. In this situation, which frequently occurs when very large concrete pads are being formed, it may be desirable to adjust the blade pitch very rapidly.

BRIEF DESCRIPTION

In one embodiment, a trowel blade pitch adjustment system comprises a rack located within a handle tube of a concrete trowel. The rack is attached to the handle tube such that motion relative to the rack is also relative to the handle tube. The system further comprises a pitch block located within the handle tube, the pitch block comprising an aperture containing one or more pins biased onto the rack by an angled upper surface and a biasing spring, thereby frictionally locking the pitch block to the rack. The system further comprises a release located within the handle tube and configured to compress the biasing spring upon actuation, thereby releasing the frictional lock between the pitch block and the rack. The system further comprises a tension cable coupled to the pitch block and extending through the handle tube to engage with a blade rotation apparatus configured to pivotally rotate one or more blades of the concrete trowel.

In another embodiment, a trowel blade pitch adjustment system comprises a first member located within a handle tube of a concrete trowel and attached to the handle tube such that motion relative to the first member is also relative to the handle tube. The system further comprises a second member located within the handle tube and configured to selectively frictionally engage with the first member using a biasing spring, and a blade rotation apparatus in communication with the second member and configured to pivotally rotate one or more blades of the concrete trowel.

In another embodiment, a concrete finishing machine comprises a rotatable trowel blade assembly comprising a plurality of trowel blade arms projecting radially outwardly from a common hub, each arm carrying a trowel blade, and an engine coupled to the rotatable trowel blade assembly. The concrete finishing machine further comprises a tubular machine handle coupled to the rotatable trowel blade assembly and a blade pitch adjustment system comprising a linear lost motion mechanism located within the tubular machine handle.

In another embodiment, a linear lost motion mechanism is located within a tubular handle of a machine. The linear lost motion mechanism comprises a first member located within the tubular handle and configured to selectively frictionally engage with a second member using a biasing spring. The linear lost motion mechanism further comprises a release located within the tubular handle and configured to compress the biasing spring upon actuation, thereby releasing the first member from its selective frictional engagement with the second member.

These and other embodiments of the present application will be discussed more fully in the detailed description. The features, functions, and advantages can be achieved independently in various embodiments of the present application, or may be combined in yet other embodiments.

DRAWINGS

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

The present application describes a linear lost motion mechanism located within a tubular handle of a machine. Although this mechanism is described primarily with reference to adjusting the blade pitch of a concrete finishing machine, those of ordinary skill in the art will appreciate that the linear lost motion mechanism can be used to perform numerous other functions in connection with a wide variety of machines. For example, in some embodiments, the linear lost motion mechanism can be used to control the blade depth of a concrete saw or to control a remote throttle assembly of any machine having a suitable engine.

Figure 1:
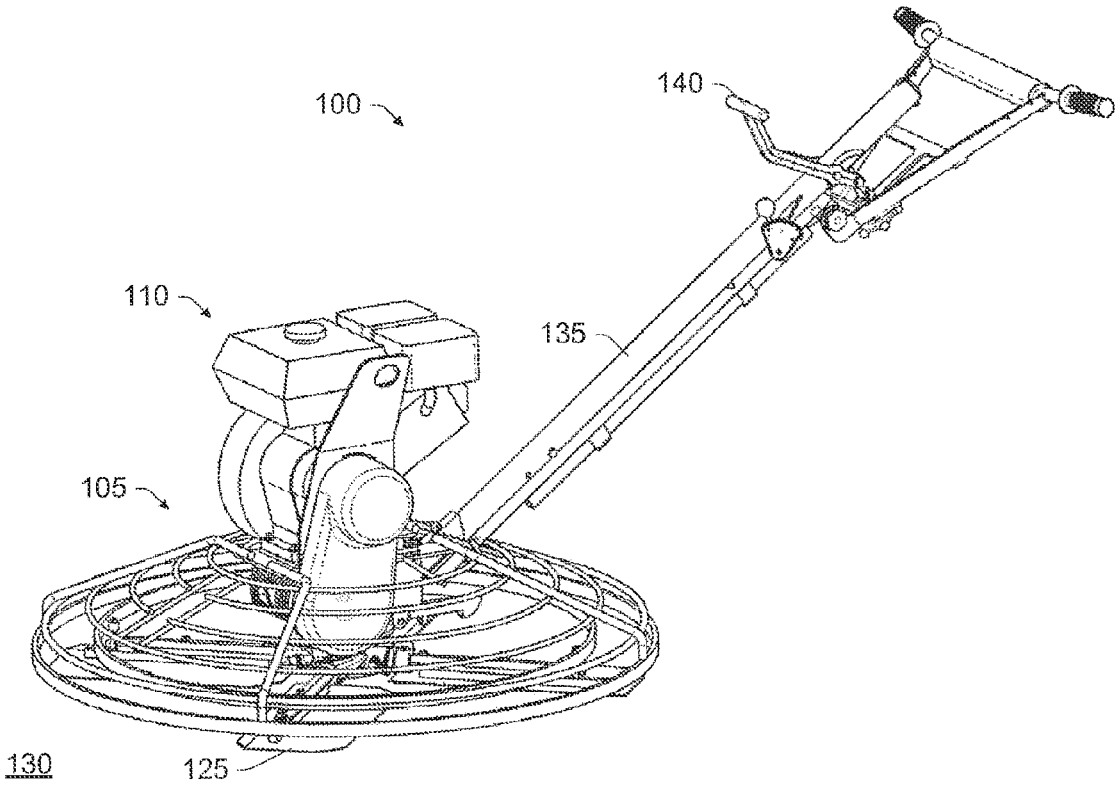
FIG. 1 is a perspective view of one embodiment of a concrete finishing machine having a blade pitch adjustment system.

FIG. 1 illustrates one embodiment of a concrete finishing machine 100 having a blade pitch adjustment system. In the illustrated embodiment, the machine 100 comprises a rotatable trowel blade assembly 105 rotatably driven by a suitable engine 110. The trowel blade assembly 105 includes a plurality (e.g., three or four) of uniformly-spaced trowel blade arms projecting radially outwardly from a common hub, each arm carrying a separate trowel blade 125. The blades 125 rest directly on a wet, semi-plastic concrete surface 130 to be finished, which supports the weight of the machine 100. The machine 100 also comprises a tubular machine handle 135, which can be used by an operator to guide and control the machine 100.

In operation, the pitch of the trowel blades 125 relative to the concrete surface 130 on which they rest can be manually adjusted using the blade pitch adjustment system of the present application. In the illustrated embodiment, and operator actuates the blade pitch adjustment system using pitch handle 140 pivotally secured to the tubular machine handle 135. In other embodiments, the blade pitch adjustment system can be actuated using a variety of other suitable mechanisms, such as, for example, levers, linear actuators, etc. An embodiment having a linear actuator 285 extending through a straight slot 290 in the tubular machine handle 205 is shown in FIGS. 4A and 4B. The linear actuator 285 can be attached to the release (225 in FIG. 3B) inside the tube 205, and performs substantially the same function as the pitch handle 140, but moves the release 225 via linear motion, rather than pivotal motion. An operator makes blade pitch adjustments based on the hardness or plasticity of the concrete surface 130, beginning with the blades 125 lying substantially flat on the surface 130 when the concrete is very wet or plastic, and ending with the blades 125 at a substantial angle (e.g. about 30 degrees) when the concrete has substantially hardened.

When an operator moves the pitch handle 140, it actuates a linear lost motion mechanism contained within the tubular machine handle 135, as described in more detail below with reference to FIGS. 2 and 3. This linear lost motion mechanism, in turn, can interface with a number of suitable and well-known systems configured to control pivotal rotation of the individual trowel blades 125 to accomplish the desired blade pitch adjustment. For example, in some embodiments, the linear lost motion mechanism actuates a tension cable that extends through the tubular machine handle 135 to engage a suitable blade rotation apparatus located on or under the gear box of the concrete finishing machine 100. The linear lost motion mechanism may also interface with a suitable counterbalancing apparatus, such as a compressed coil spring located within the tubular machine handle 135, to provide mechanical advantage in rotating the trowel blades 125.

Figures 2A, 2B:
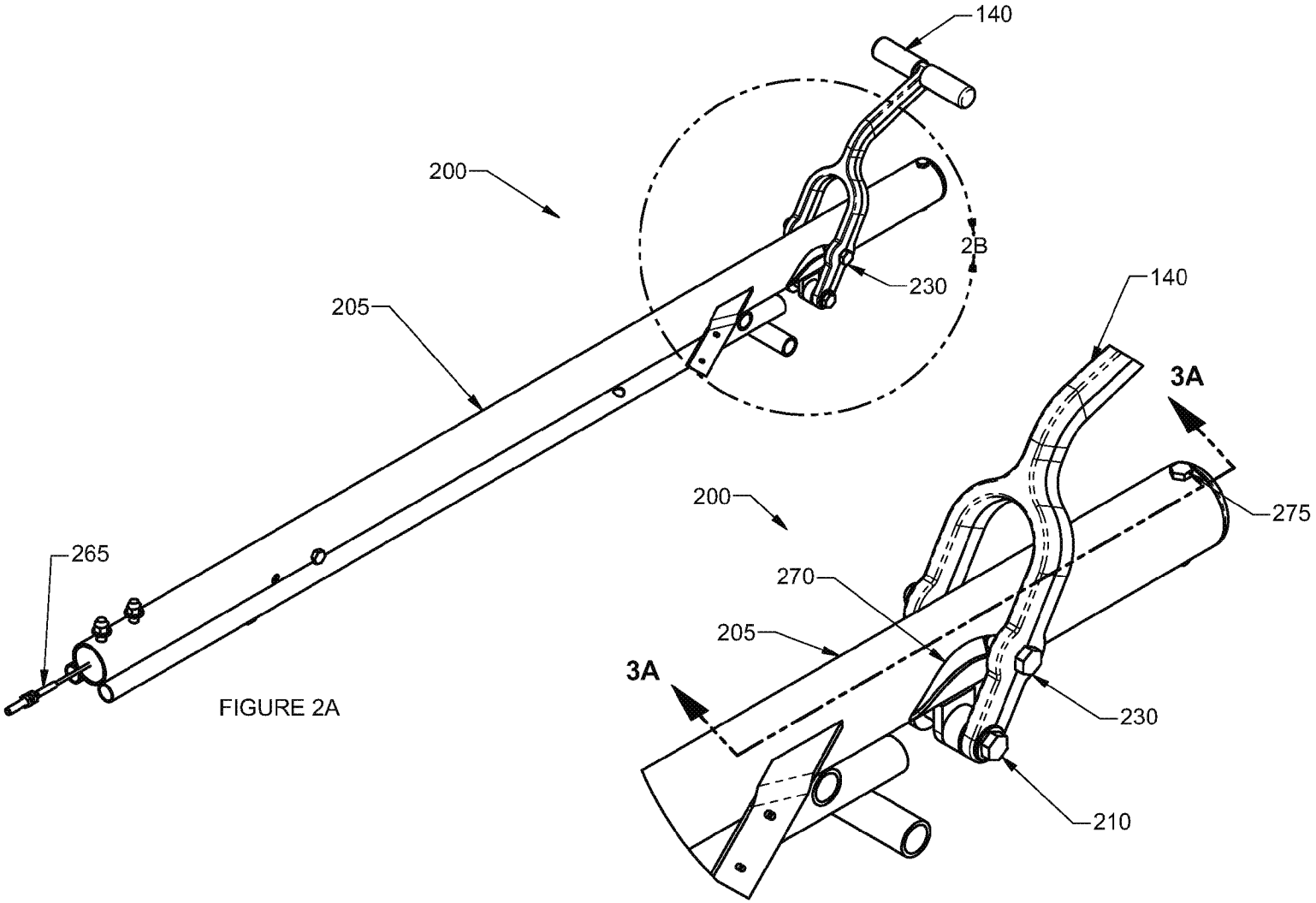
FIG. 2A is a perspective view the tubular handle of the concrete finishing machine shown in FIG. 1.
FIG. 2B is an enlarged view of the area circumscribed by the circle 2B in FIG. 2A.
Figure 3A:
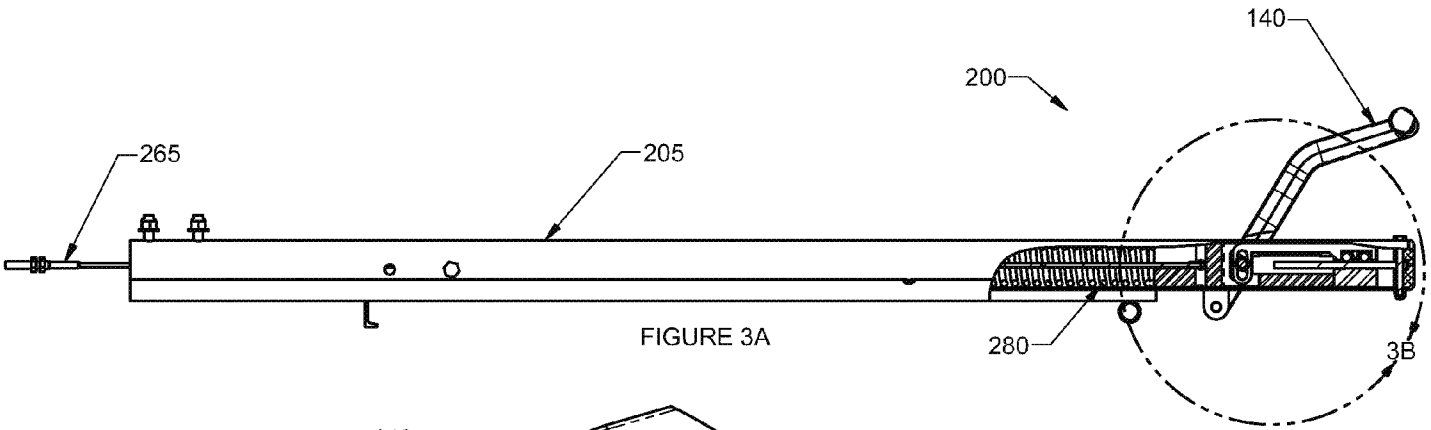
FIG. 3A is a side partial cutaway view of the tubular handle of the concrete finishing machine shown in FIG. 1.
Figure 3C:
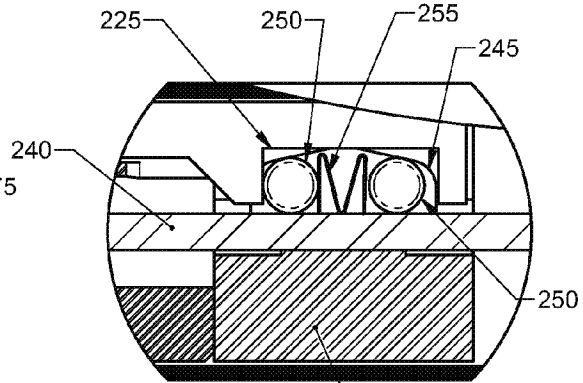
FIG. 3C is a further enlarged view of the area circumscribed by circle 3C in FIG. 3B.

FIGS. 2 and 3 illustrate one embodiment of the tubular machine handle 135 shown in FIG. 1. The handle 135 comprises a linear lost motion mechanism 200 contained within a handle tube 205. In the illustrated embodiment, the linear lost motion mechanism 200 is actuated by the pitch handle 140, which is mounted to the handle tube 205 at a pivot point 210. The pitch handle 140 actuates the linear lost motion mechanism 200 through an arced slot 270 in the handle tube 205. In other embodiments, the linear lost motion mechanism 200 can be actuated using a variety of other suitable mechanisms, such as linear actuators directly coupled to one or more components of the linear lost motion mechanism 200 through straight slots in the handle tube 205.

Figure 3B:
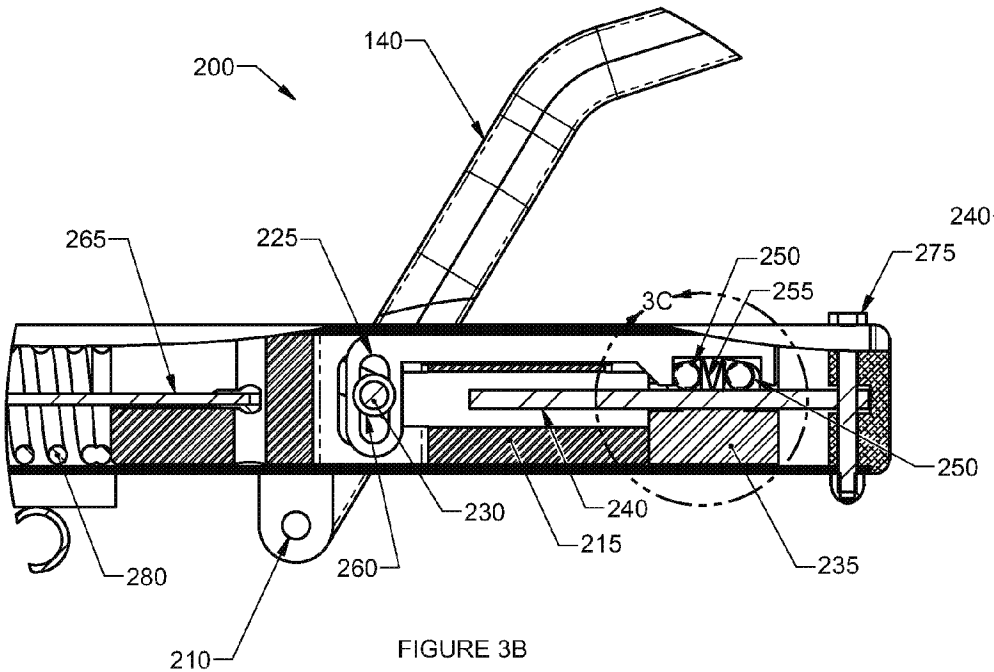
FIG. 3B is an enlarged view of the area circumscribed by circle 3B in FIG. 3A.
Figures 4A, 4B:
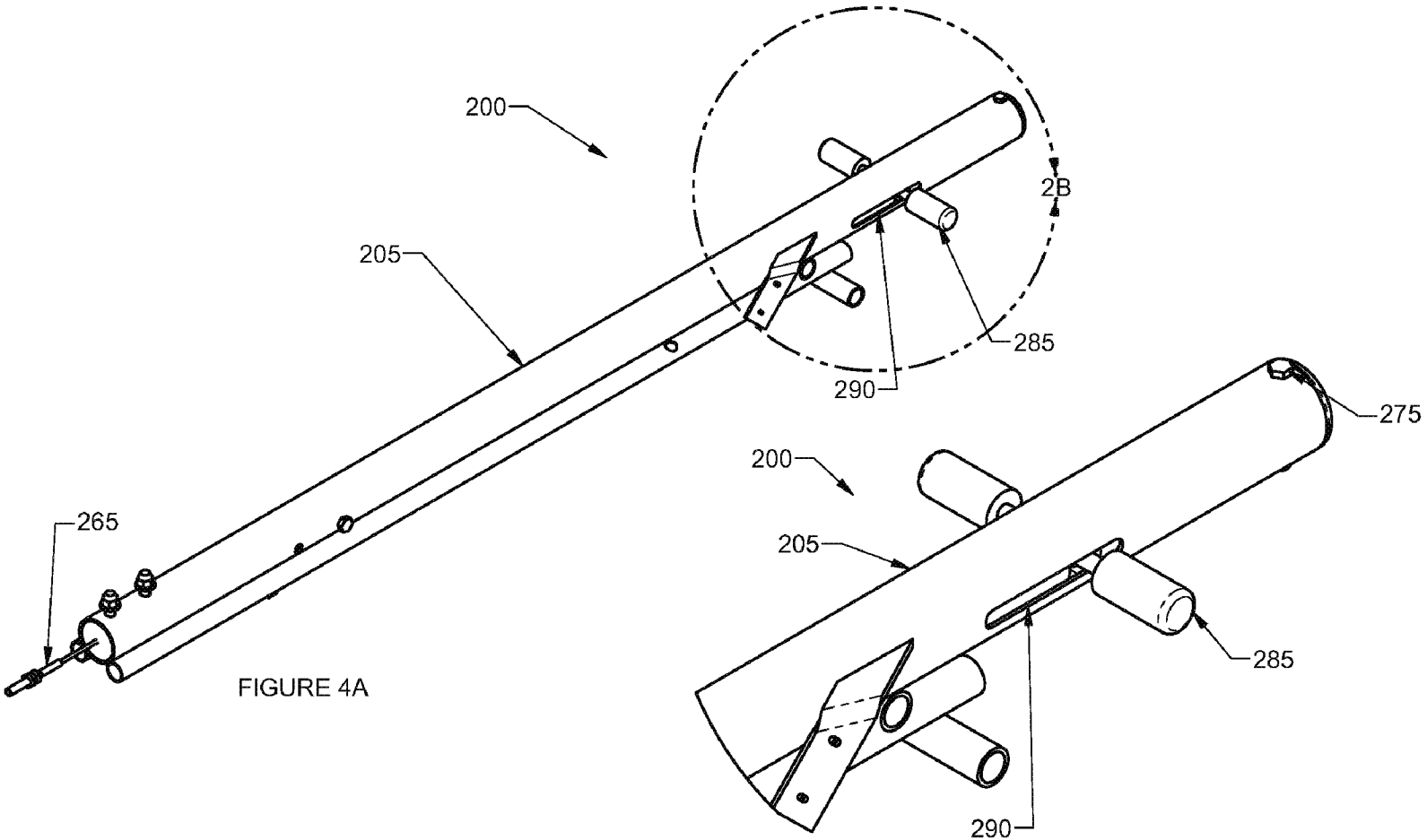
FIG. 4A is a perspective view of another embodiment of a tubular handle of a concrete finishing machine in accordance with the present disclosure, having a linear actuator.
FIG. 4B is an enlarged view of the area circumscribed by the circle 4B in FIG. 4A.

As illustrated in FIG. 3B, the linear lost motion mechanism 200 comprises a pitch block 215 having an aperture 220 through which the pitch handle 140 can engage a release 225 via a suitable engagement device 230, such as a fastener or pin. The linear lost motion mechanism 200 further comprises an optional pitch block extension 235 configured to frictionally engage a rack 240, which is attached to the handle tube 205 with a fastener 275, such that motion relative to the rack 240 is also relative to the handle tube 205. In other embodiments, the pitch block 215 (or optional pitch block extension 235) can be configured to frictionally engage directly with the handle tube 205, thereby eliminating the need for the rack 240.

In the exemplary embodiment shown in FIGS. 2 and 3, the pitch block extension 235 comprises a cylindrical member having an aperture with a peaked upper surface forming two ramps 245. In this example, the pitch block extension 235 frictionally engages with the rack 240 via two cylindrical pins 250 that are biased onto the rack 240 by the ramps 245 and a biasing spring 255. In other embodiments, the ramps 245 are inverted from what is shown in FIG. 3B, and the pitch block extension 235 frictionally engages directly with the handle tube 205 via two barrel-shaped pins matching the inner diameter of the handle tube 205 and biased onto the handle tube 205 with a biasing spring 255.

Figure 5A:
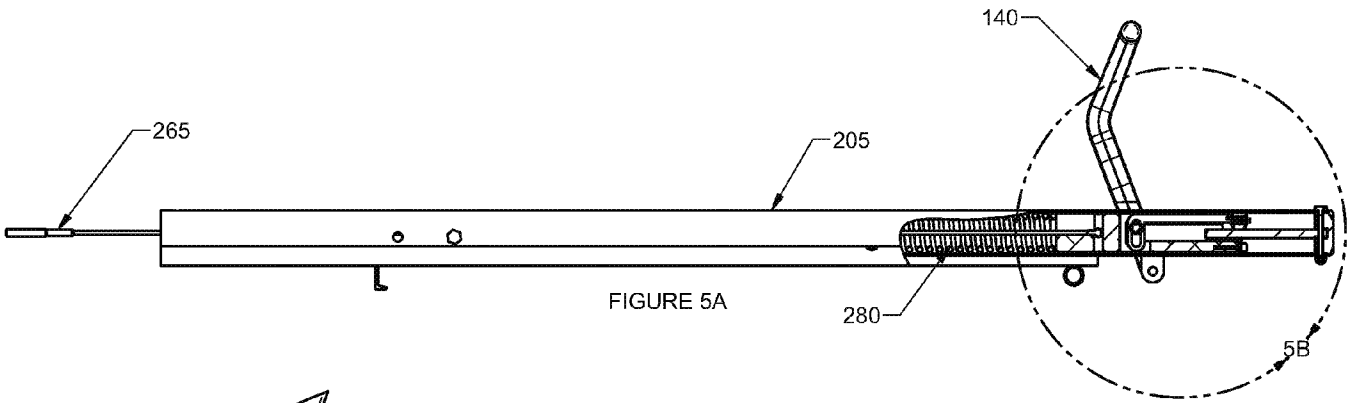
FIG. 5A is a side partial cutaway view of another embodiment of a tubular handle of a concrete finishing machine in accordance with the present disclosure, having a linear actuator.
Figure 5C:
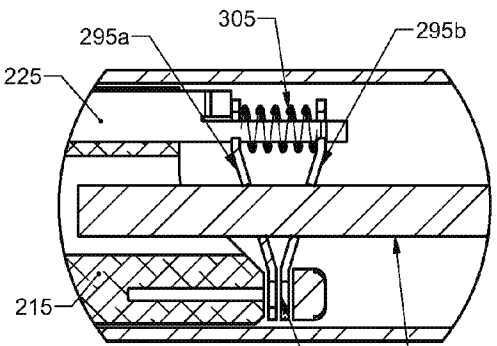
FIG. 5C is a further enlarged view of the area circumscribed by the circle 5C in FIG. 5B.
Figure 5B:
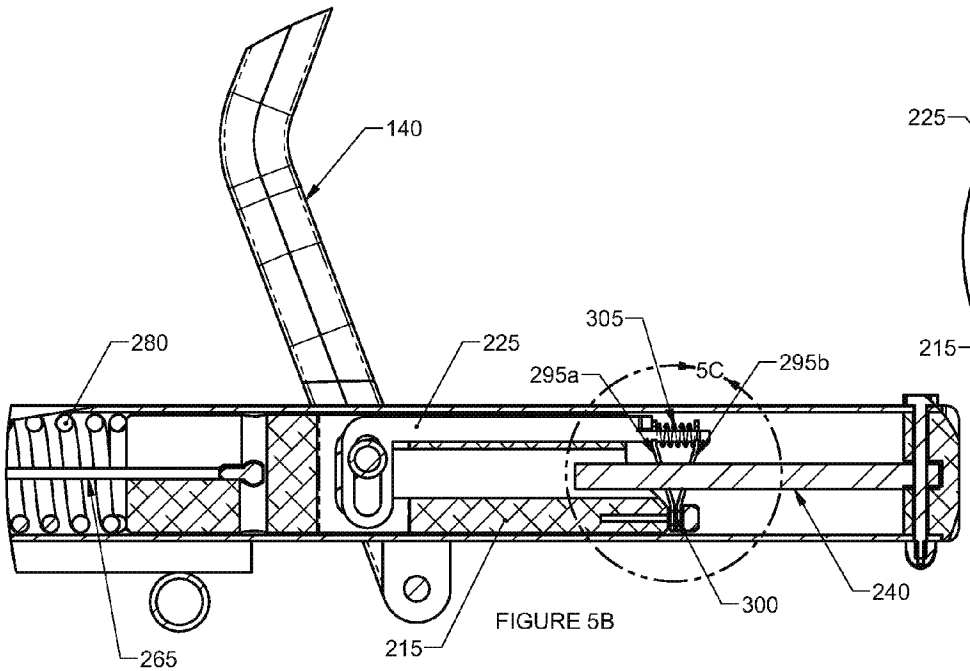
FIG. 5B is an enlarged view of the area circumscribed by the circle 5B in FIG. 5A.

Alternatively, the pitch block extension 235 may comprise a wide variety of other suitable devices configured to frictionally engage the rack 240 with a biasing spring. For example, in some embodiments, the pitch block extension 235 may comprise a pair of slotted tabs 295*a, b*, shown in FIGS. 5A-5C, through which the rack 240 extends. The tabs may be fastened together at one end 300 and biased apart with a biasing spring 305 at the other end to frictionally engage the slots with the rack 240. Various other mechanisms for frictionally engaging the pitch block extension 235 with the rack 240 using a biasing spring will become apparent to those of skill in the art in view of the present disclosure.

Referring again to the embodiment illustrated in FIGS. 2 and 3, when the linear lost motion mechanism 200 is in a "static" condition, the biasing spring 255 forces the pins 250 in opposite directions from each other and into the ramps 245 in the pitch block extension 235. As a result, the rack 240 is forced into the pitch block extension 235, which frictionally locks the rack 240 to the pitch block extension 235. In this situation, if the pitch block extension 235 tries to move relative to the rack 240, one of the pins 250 will try to roll further into the corresponding ramp 245, thereby increasing the frictional lock between the rack 240 and the pitch block extension 235, and resisting any movement.

When an operator desires to adjust the blade pitch, the operator rotates the pitch handle 140, causing the release 225 to compress the biasing spring 255 and move one of the pins 250 away from the corresponding ramp 245 in the pitch block extension 235. This movement releases the rack 240 from the pitch block extension 235, thereby allowing the pitch block 215 and the pitch block extension 235 to move relative to the rack 240 in the direction of rotation of the pitch handle 140. At the same time, a bearing 260 pushes against the pitch block 215, causing it and the pitch block extension 235 to move in the direction of rotation of the pitch handle 140.

The movement of the pitch block 215 and the pitch block extension 235 relative to the rack 240 may change the blade pitch of the concrete finishing machine 100 using a variety of suitable techniques. For example, in the illustrated embodiment, the pitch block 215 is coupled to a tension cable 265, which extends through the handle tube 205 and engages with a suitable blade rotation apparatus located on or under the gear box of the concrete finishing machine 100. In some embodiments, the concrete finishing machine 100 includes a suitable counterbalancing apparatus, such as a compressed coil spring 280 located within the tubular machine handle 135, coaxial with the tension cable 265, to provide mechanical advantage to the operator when rotating the pitch handle 140.

When the operator releases the pitch handle 140, the release 225 ceases to exert force on the biasing spring 255, and the linear lost motion mechanism 200 returns to the "static" condition described above. In this condition, the biasing spring 255 forces the pins 250 into the ramps 245, which causes the rack 240 to become frictionally locked with the pitch block extension 235. As a result, the blade pitch remains locked in its current position when the operator releases the pitch handle 140.

The trowel blade pitch adjustment system of the present application exhibits distinct advantages over conventional systems. For example, the blade pitch adjustment system described above utilizes an efficient linear lost motion mechanism, which advantageously enables operators to rapidly adjust the blade pitch of the concrete finishing machine 100 when desired. In addition, unlike many conventional systems, the blade pitch adjustment system of the present application is advantageously contained entirely within the tubular machine handle 135, thereby providing additional protection from potentially harsh environmental conditions and other wear and tear.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A trowel blade pitch adjustment system comprising:

a rack located within a handle tube of a concrete trowel, the rack attached to the handle tube such that motion relative to the rack is also relative to the handle tube;

a pitch block located within the handle tube, the pitch block comprising an aperture containing one or more pins biased onto the rack by an angled upper surface and a biasing spring, thereby frictionally locking the pitch block to the rack;

a release located within the handle tube and configured to compress the biasing spring upon actuation, thereby releasing the frictional lock between the pitch block and the rack; and a tension cable coupled to the pitch block and extending through the handle tube to engage with a blade rotation apparatus configured to pivotally rotate one or more blades of the concrete trowel.

2. The trowel blade pitch adjustment system of claim 1, wherein the pitch block comprises a main pitch block member and a pitch block extension member.

3. The trowel blade pitch adjustment system of claim 1, wherein the aperture in the pitch block has a peaked upper surface forming two ramps.

4. The trowel blade pitch adjustment system of claim 1, wherein the pins comprise two cylindrical pins.

5. The trowel blade pitch adjustment system of claim 1, further comprising a pitch handle pivotally secured to the handle tube and configured to actuate the release through an arced slot in the handle tube.

6. The trowel blade pitch adjustment system of claim 1, further comprising a linear actuator coupled to the release through a straight slot in the handle tube.

7. The trowel blade pitch adjustment system of claim 1, further comprising a compressed coil spring located within the handle tube, coaxial with the tension cable.

8. A trowel blade pitch adjustment system comprising:

a first member located entirely within a handle tube of a concrete trowel and attached to the handle tube such that linear motion relative to the first member is also linear motion relative to the handle tube;

a second member located within the handle tube and configured to selectively frictionally engage with the first member using a biasing spring, the second member comprising an aperture having a peaked upper surface and two cylindrical pins biased onto the first member by the biasing spring; and a blade rotation apparatus in communication with the second member and configured to pivotally rotate one or more blades of the concrete trowel.

9. The trowel blade pitch adjustment system of claim 8, further comprising a release located within the handle tube and configured to compress the biasing spring upon actuation.

10. The trowel blade pitch adjustment system of claim 8, wherein the blade rotation apparatus is in communication with the second member via a tension cable extending through the handle tube.

11. The trowel blade pitch adjustment system of claim 8, wherein the blade rotation apparatus comprises a counterbalancing apparatus configured to provide mechanical advantage in rotating the concrete trowel blades.

12. A trowel blade pitch adjustment system, comprising:

a first member located entirely within a handle tube of a concrete trowel and attached to the handle tube such that linear motion relative to the first member is also linear motion relative to the handle tube;

a second member located within the handle tube and configured to selectively frictionally engage with the first member using a biasing spring, the second member comprising two slotted tabs through which the first member extends, the slotted tabs being fastened together at a first end and biased apart with a biasing spring at a second end; and a blade rotation apparatus in communication with the second member and configured to pivotally rotate one or more blades of the concrete trowel.

13. The trowel blade pitch adjustment system of claim 12, further comprising a release located within the handle tube and configured to compress the biasing spring upon actuation.

14. The trowel blade pitch adjustment system of claim 12, wherein the blade rotation apparatus is in communication with the second member via a tension cable extending through the handle tube.

15. The trowel blade pitch adjustment system of claim 12, wherein the blade rotation apparatus comprises a counterbalancing apparatus configured to provide mechanical advantage in rotating the concrete trowel blades.

* * * * *